US005816878A

United States Patent [19]

McNamee

[11] Patent Number: 5,816,878

[45] Date of Patent: Oct. 6, 1998

[54] TRIGGER DEVICE

[75] Inventor: John Boden McNamee, Kellyville, Australia

[73] Assignee: Flube Pty., Ltd., Kellyville, Australia

[21] Appl. No.: 737,777

[22] PCT Filed: May 29, 1995

[86] PCT No.: PCT/AU95/00310

§ 371 Date: Nov. 25, 1996

§ 102(e) Date: Nov. 25, 1996

[87] PCT Pub. No.: WO95/32891

PCT Pub. Date: Dec. 7, 1995

[30] Foreign Application Priority Data

May 27, 1994 [AU] Australia ..... PM5912
Sep. 29, 1994 [AU] Australia ..... PM8502

[51] Int. Cl.[6] ..... B63C 9/125

[52] U.S. Cl. ..... 441/93; 441/88

[58] Field of Search ..... 441/90, 92–97; 222/3, 5, 54

[56] References Cited

U.S. PATENT DOCUMENTS 2,971,257 2/1961 Everett .
3,127,624 4/1964 Kubit et al. ..... 222/5
3,180,524 4/1965 Shepard et al. .
3,465,375 9/1969 Schnell ..... 441/94

FOREIGN PATENT DOCUMENTS 2617794 1/1989 France .
182983 7/1922 United Kingdom .
576041 3/1946 United Kingdom .
1514533 6/1978 United Kingdom .

*Primary Examiner*—Ed L. Swinehart
*Attorney, Agent, or Firm*—Ostrolenk, Faber, Gerb & Soffen, LLP

[57] ABSTRACT

A trigger device enabling a larger actuating force to be restrained by a smaller control force comprises a housing in which is rotatably mounted a primary lever biased to rotate from a cocked position to a firing position by a tension spring. The tension spring is located such that the rotational bias to the primary lever is significantly greater in the firing position than in the cocked position. The trigger device is typically used for both automatic and manual release of compressed gas from a bottle to an inflatable life-saving aid by way of a piercing pin moved by a cam surface on a secondary lever which can be manually rotated by a toggle or automatically by the primary lever on the dissolving of a water-soluble tablet restraining the primary lever in the cocked position.

10 Claims, 15 Drawing Sheets

TRIGGER DEVICE

TECHNICAL FIELD

This invention relates to a trigger device and has been devised particularly though not solely for activating the inflation mechanism of an inflatable water safety device or triggering the release of a container holding such devices.

BACKGROUND ART

There are many types of inflatable life-saving devices such as life jackets and similar inflatable aids where it is desired to automatically inflate the device upon immersion in water. Life jackets of this type are commonly provided with trigger devices which incorporate a soluble tablet designed to dissolve quickly upon immersion in water and release a mechanism which will typically pierce the sealed neck of a $CO_2$ bottle releasing compressed gas to inflate the life jacket or other device. Known trigger devices of this type have the disadvantage that a considerable force is needed to pierce the sealed neck of the $CO_2$ bottle and this force must be resisted by the soluble tablet. When a force of this magnitude is applied to a soluble tablet over a period of time, the tablet is prone to breakdown either from the force alone, or from a combination of the applied force and deterioration of the tablet (eg: from air humidity) causing the inadvertent operation of the trigger device and the unintentional inflation of the life jacket. Alternatively secondary mechanisms must be used to retain the force.

There are many other situations where it is desirable to provide a trigger device where a potential operating force necessary to actuate a desired mechanism can be restrained by a much smaller control force. The control force may be a soluble tablet of the type described above or some other manually or automatically actuated force applied to remotely release the trigger device which will in turn actuate the desired mechanism.

The aim of trigger devices of this type is to resist or contain the relatively larger actuating force by a comparatively small control force.

DISCLOSURE OF INVENTION

The present invention therefore provides a trigger device adapted to actuate a desired mechanism, said trigger device comprising a primary lever mounted at one end thereof to a support structure, tensioning means connected between a force actuation point on the lever remote from the pivot and an anchor point on the support structure, arranged to bias the lever into a firing position wherein the mechanism is actuated, and restraint means operable between the lever and the support structure at a point on the lever remote from the pivot and arranged to hold the lever in a cocked position against the bias of the tensioning means until the device is fired by operation of the restraint means allowing the tensioning means to bias the lever into a firing position, and wherein the pivot, the anchor point, and the restraint means are positioned on the support means such that the distance between a line from the force application point to the anchor point and the pivot is significantly less in the cocked position than in the firing position.

In one form of the invention the restraint means comprises a water soluble tablet held between mutually facing surfaces on the primary lever and the support structure respectively.

Preferably the trigger device incorporates a cocking lever rotatable to apply tensioning force to the tensioning means.

In one form of the invention the line from the force application point to the anchor point lies on the same side of the pivot in both the cocked and firing positions.

In an alternative form of the invention the line from the force application point to the anchor point lies on one side of the pivot in the cocked position and on the opposite side of the pivot in the firing position, such that in the cocked position the lever is held in an "over centre" location against an abutment on the support structure and the restraint means is operable to rotate the lever from this position past the on-centre position permitting the tensioning means to further rotate the lever into the firing position.

Preferably the tensioning means comprise a tension spring.

When the trigger device is used to actuate an inflation mechanism, the lever is arranged to operate a piercing mechanism to release the contents of a $CO_2$ cylinder, when moved from the cocked to the firing position.

BRIEF DESCRIPTION OF DRAWINGS

Notwithstanding any other forms that may fall within its scope, one preferred form of the invention will now be described by way of example only with reference to the accompanying drawings, in which.

MODES FOR CARRYING OUT THE INVENTION

One preferred application of the trigger device for use in inflating life-saving devices such as inflatable tubes or hoops or inflatable life jackets will now be described with reference to FIGS. 1 to 8 of the drawings followed by a description of alternative forms of trigger and alternative applications by way of example only. It will however be appreciated that a trigger device of this type can be used in any situation requiring either automatic or remote actuation where it is desired to release a significant actuating force by operation of a relatively small control force or restraint.

Figure 8:
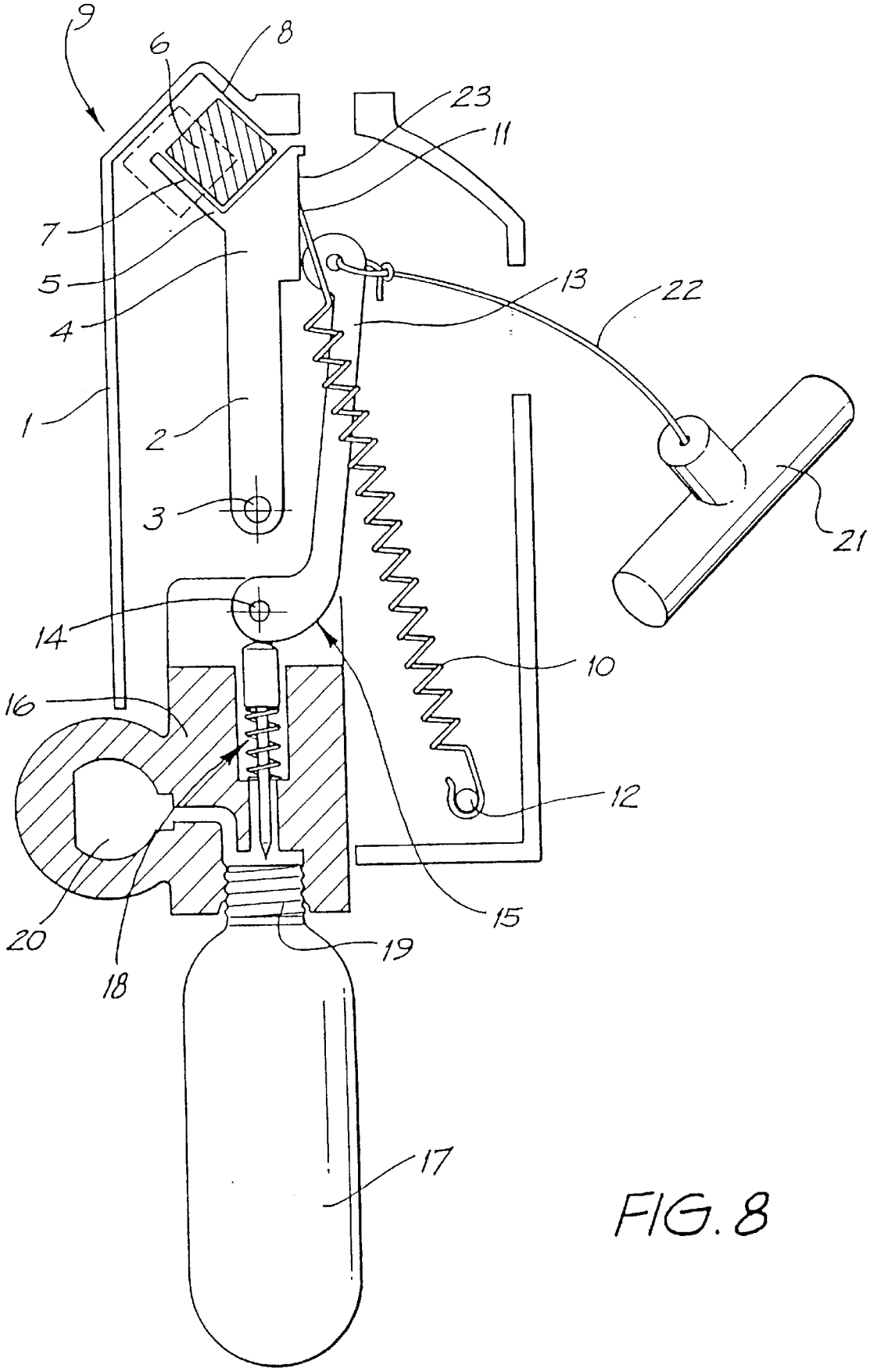
FIG. 8 is a cross-sectional elevation through the device of FIG. 7 showing a $CO_2$ bottle in place in the apparatus.

Referring firstly to FIG. 8, the trigger device for use in automatically inflating life jackets and the like comprises a support structure 1 which is typically a semi-enclosed housing (see FIG. 7) in which primary lever 2 is rotatably mounted by way of a pivot 3.

Provided on the lever at one end 4 remote from the pivot 3 is a hopper 5 (see also FIG. 1) adapted to hold a soluble tablet 6 when the trigger device is in the cocked position as shown in FIG. 8 and as will be described further later, the soluble tablet 6 is wedged between one side 7 of the hopper 5 and a corresponding facing abutment 8 formed in the side wall 9 of the support structure.

The trigger device is further provided with tensioning means in the form of a tension spring 10 which is connected between a force application point 11 on the lever 2 remote from the pivot 3 and an anchor point 12 on the support structure. Although the tension spring appears as a single spring in FIG. 8, it is typically formed from two parallel springs as is apparent from FIG. 1.

The tension spring 10 exerts a force on the lever 2 at force application point 11 tending to cause the lever to rotate in a clockwise direction as seen in FIG. 8. This movement is resisted by the soluble tablet 6 between the abutment faces 7 and 8.

The trigger device further comprises a cam actuating lever 13 rotatable about a pivot pin 14 and which also incorporates a cam surface 15. The cam lever pivot 14 is held in a housing 16 which is typically a proprietary item forming a support for a compressed $CO_2$ bottle 17 and a piercing pin mechanism 18 which is operable to pierce the sealed neck 19 of the bottle upon rotation of the cam face 15 about the cam pivot 14. Once the $CO_2$ bottle neck is pierced by the actuating pin, compressed gas is released via passageway 20 which is in turn connected to a life-saving device for inflation of that device.

The release mechanism for the $CO_2$ bottle 17 may either be actuated manually by pulling on a toggle handle 21 attached to a lanyard 22 to rotate the cam actuating lever 13 about the cam pivot 14 or by automatic operation via the lever 2 causing abutting face 23 on the lever to press against the end of the cam actuating lever 13 causing rotation of the cam actuating lever to the release position.

The specific operation of the automatic trigger device will now be described in more detail with reference to FIGS. 2 to 5.

The trigger device is typically provided with a safety pin 24 inserted into the top of the support structure 1 through a bush 25. It is desired that the safety pin incorporate a groove or notch 26 which engages a ledge 27 on the lever arm 2 adjacent the hopper 5 to restrain the safety pin in position and prevent inadvertent removal of the safety pin, or inadvertent firing of the trigger device in the absence or collapse of the soluble tablet 6.

Figure 1:
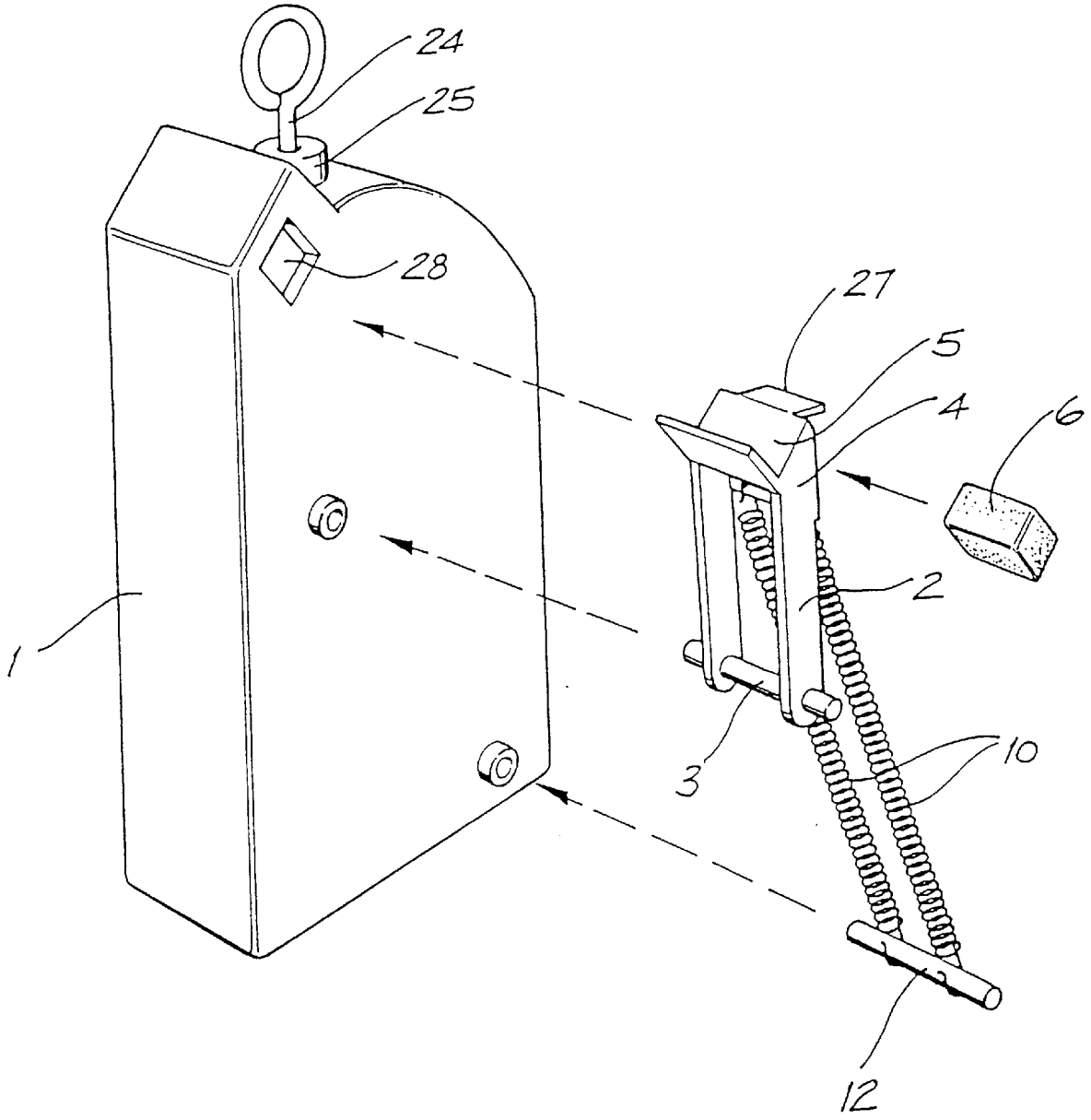
FIG. 1 is a quasi-exploded perspective view of a trigger device according to the invention with the lever, tensioning means, and restraint means removed from the support structure for clarity.
Figure 3:
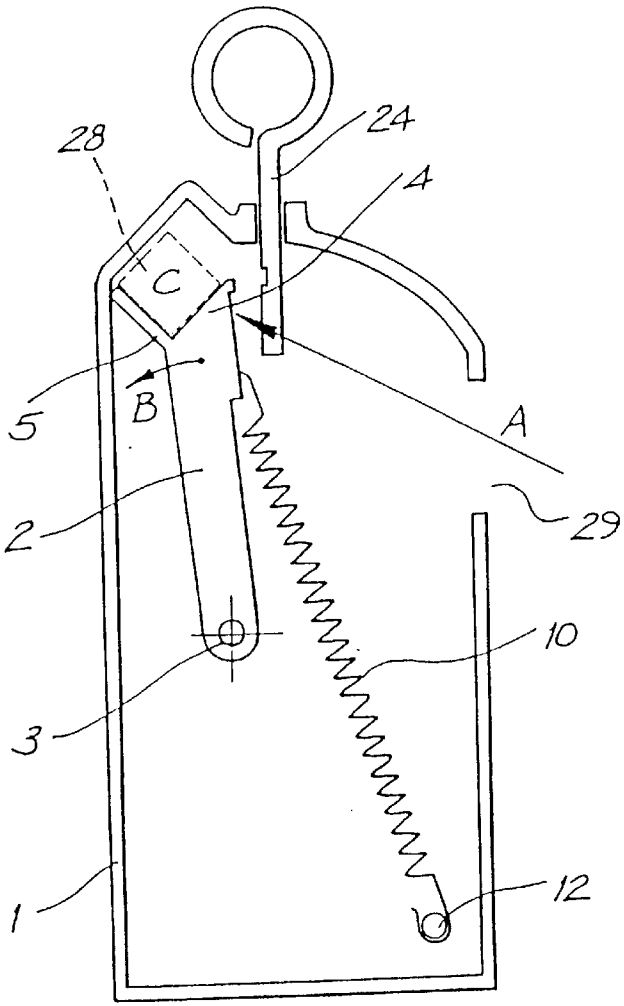
FIG. 3 is a similar view to FIG. 2 showing the lever over rotated for insertion of a soluble tablet.
Figure 2:
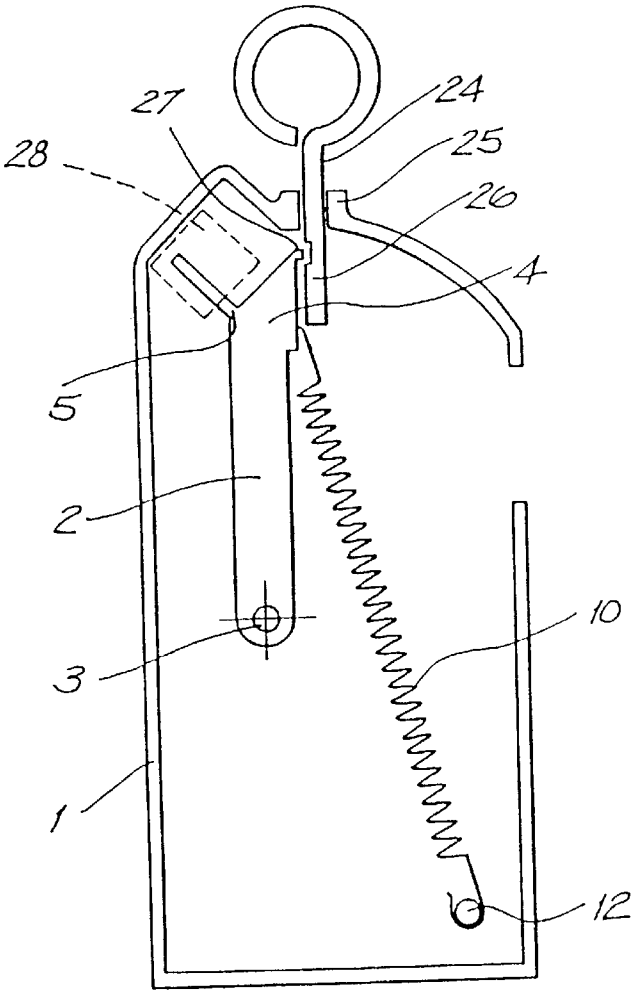
FIG. 2 is a cross-sectional elevation through the trigger device showing the lever in the cocked position.

The soluble tablet 6 is inserted into the trigger device through an aperture 28 located in one side of the support structure and which is in alignment with the hopper 5 when the lever 2 is over rotated to the position shown in FIG. 3.

Figure 4:
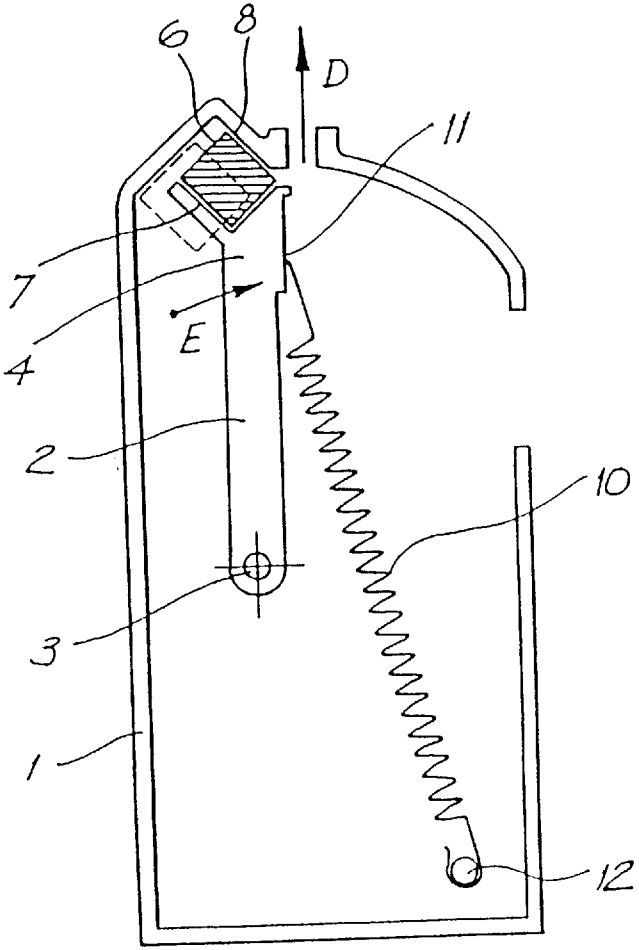
FIG. 4 is a similar view to FIG. 2 with a soluble tablet inserted and the safety pin removed ready for firing.

To "arm" the trigger device a force A is applied through opening 29 in one side wall of the support structure, eg: by using any convenient push rod, to rotate the lever in the direction shown by arrow B (FIG. 3) to a position where the hopper is aligned with opening 28 as can be seen at C. The soluble tablet 6 is then inserted through the opening 28 into the hopper 5 and the force A removed allowing the lever to rotate to the position shown in FIG. 4 where the soluble tablet abuts surfaces 7 and 8 on the hopper and support structure respectively preventing any further clockwise rotation E as seen in FIG. 4 and also preventing loss of the soluble tablet. If it is desired to fully "arm" the trigger device for firing at this time, the safety pin 24 is removed as shown by arrow D.

Figure 5:
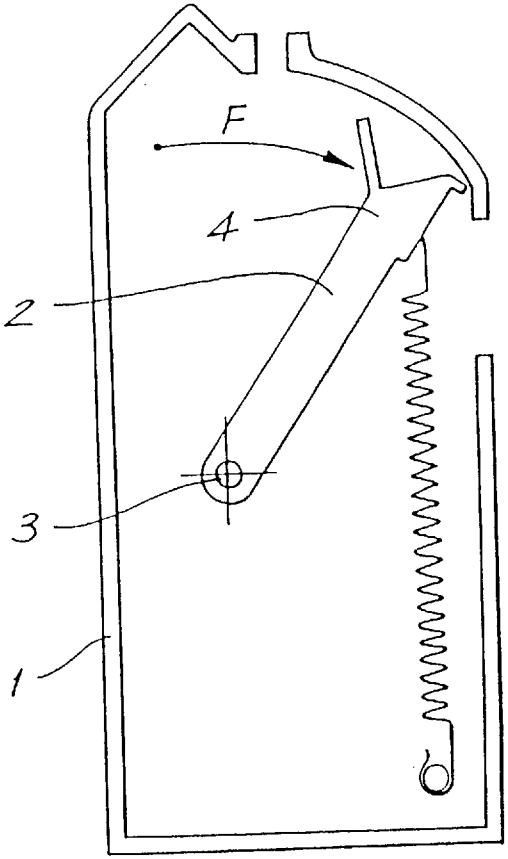
FIG. 5 is a similar view to FIG. 4 with the lever in the firing position.

If the device, in the-armed position shown in FIG. 4 is inserted in water, the soluble tablet 6 quickly dissolves allowing the spring 10 to act on force application point 11 and cause the lever 2 to rotate to the firing position through arc F as shown in FIG. 5.

Referring back to FIG. 8 it will be seen that as the lever rotates from the cocked position to the firing position, the cam actuating lever 13 is caused to rotate about the cam pivot point 14 causing the piercing mechanism 18 to release gas from the $CO_2$ bottle 17 and inflate the life-saving device.

The trigger device is configured so that the force which must be resisted by the water soluble tablet 6 when in the cocked position as shown in FIG. 4 is significantly less than the force which the lever 2 is able to apply to the cam actuating lever 13 in the firing position shown in FIG. 5. This configuration is highly desirable as the water soluble tablet 6 is prone to breaking up over a period of time when called upon to resist a large firing force of the type used in prior art devices, particularly when used in areas of high humidity or water vapour from spray may cause partial degradation of the tablet.

Figure 6:
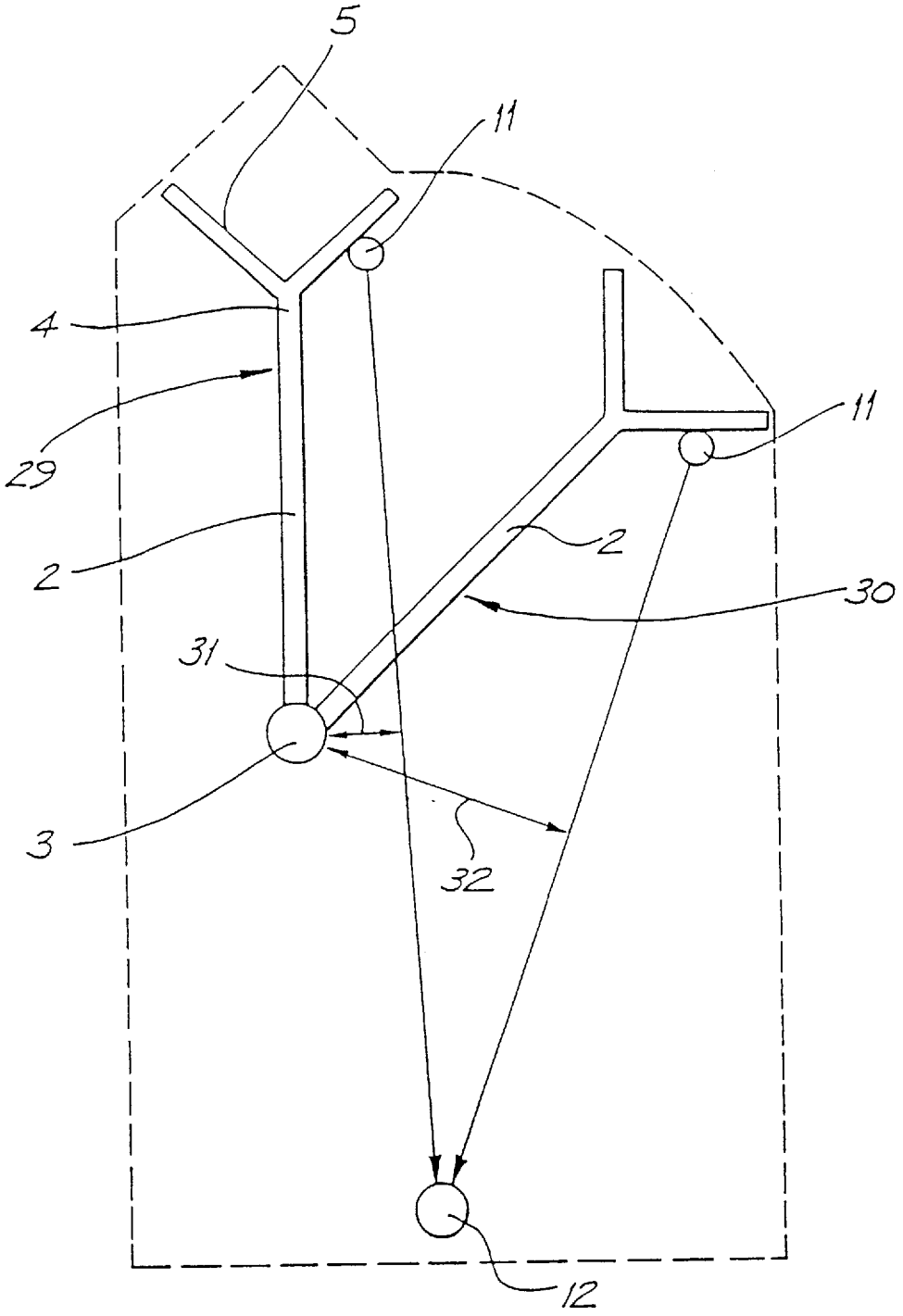
FIG. 6 is a diagrammatic view of the trigger device showing the lever in both the cocked and firing positions.
Figure 7:
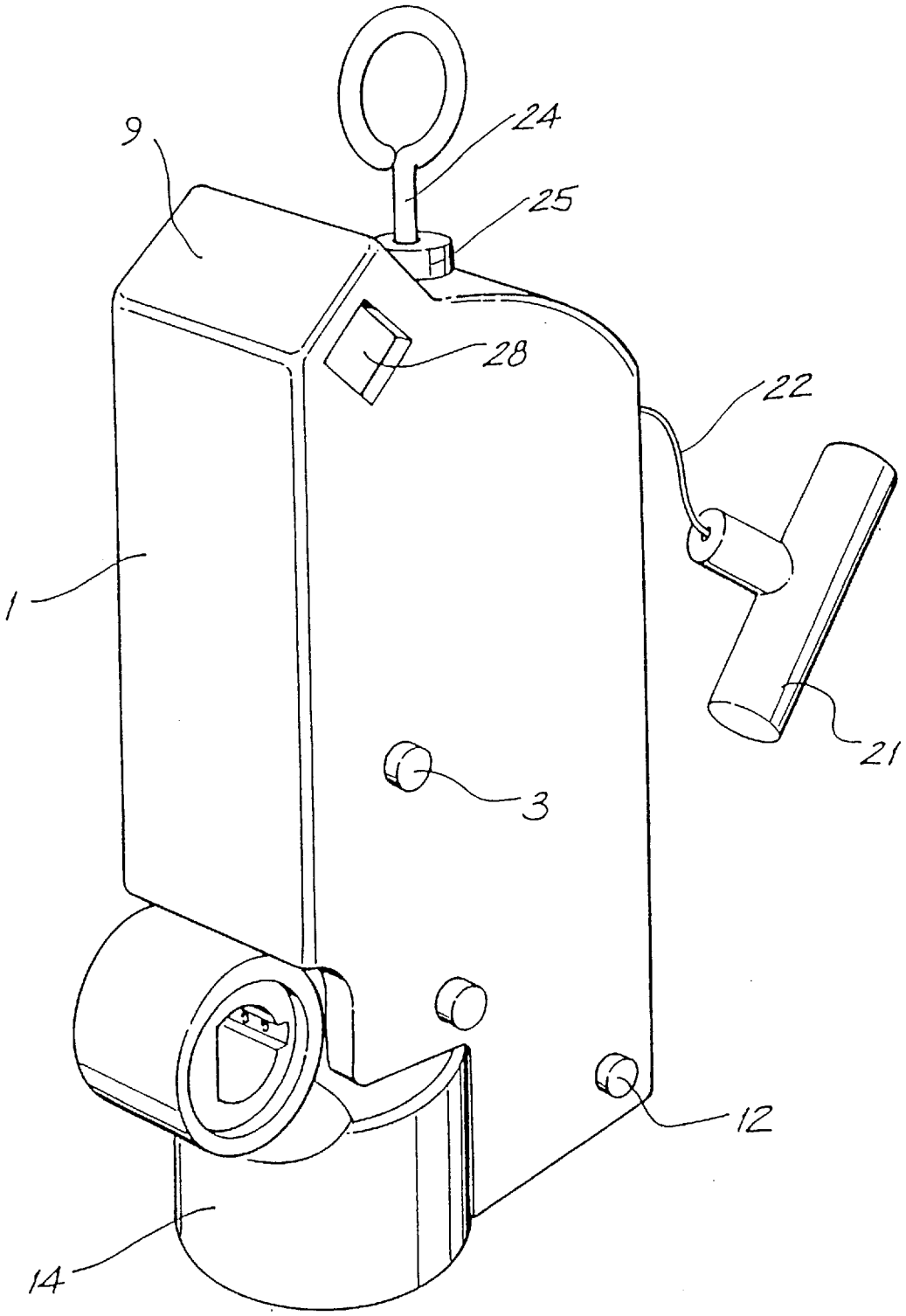
FIG. 7 is a perspective view of the complete trigger device in a configuration used for inflation of a life-saving device.

This benefit can be clearly seen with reference to FIG. 6 in which the lever arm 2 is shown in the cocked position 29 and rotated into the firing position at 30. The spring 10 applies a force on the lever 2 at force actuating point 11 and the resulting rotational moment applied to the lever is therefore the product of the force applied by the spring and the distance between a straight line from the force application point 11 to the anchor point 12. In the cocked position 29 this distance is shown at 31 and in the firing position 30 this distance is shown at 32. It will be clearly seen that distance 32 is significantly greater than distance 31 causing a significantly larger rotational moment or force to be applied to the lever 2 in the firing position 30 compared with the force or moment applied to the lever 2 in the cocked position 29, even though the spring load is reduced in the firing position.

The profile of the cam surface 15 is preferably arranged to give maximum force to the firing pin assembly 18 at its point of maximum resistance. To this end, the initial movement of the cam lever 13 about pivot 14 may not cause any movement of the pin, due to a constant radius of the cam surface 15, while the levers 2 and 13 attain momentum.

The soluble tablet 6 therefore only has to resist a comparatively small control force at the end of lever 2 in the cocked position compared with the firing force available in the firing position 30 which is available to be applied to the cam actuating lever 13 or to any other desired mechanism which may be actuated by the trigger device. This is in contrast with prior art trigger devices which either require a secondary mechanism to provide the control force to restrain the firing force, which is complicated, bulky and prone to jamming because of increased friction, or where the control force resisted by the soluble tablet is even greater than the firing force.

Examples of alternative mechanisms which may be operated by trigger devices of this type will now be described.

Figure 9:
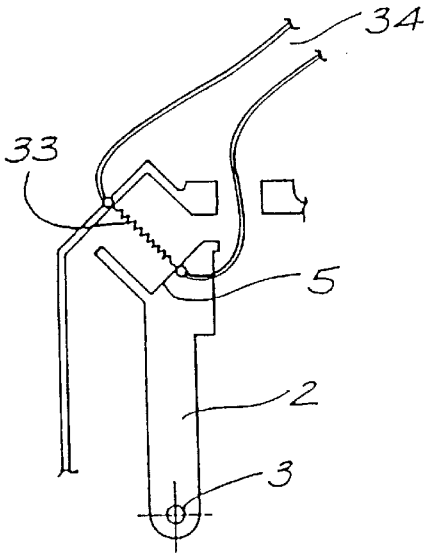
FIG. 9 is a diagrammatic view of an alternative form of the trigger device using a fusible link in place of the soluble tablet.

As an alternative to controlling the trigger device by a soluble tablet, it is possible to use other forms of control such as an electrically actuated fusible link as can be seen at 33 in FIG. 9. The link may be connected to a supply of electricity via cables 34 so that when a circuit is closed and electrical current is passed through the link 33, the link fuses and breaks releasing the lever 2 to pivot about pivot point 3 under the influence of the tension spring (not shown). Movement of the lever arm 3 can be used to actuate any desired mechanism in a manner which is cheaper and more reliable than an electrical solenoid.

Figure 10:
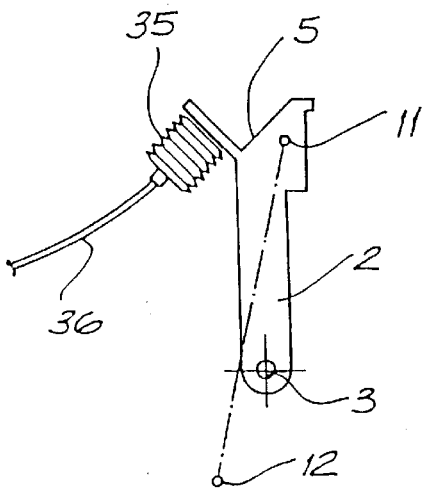
FIG. 10 is a similar view to FIG. 9 showing the use of a pressure bellows to fire the trigger device in place of a soluble tablet.

There are some instances of remotely actuated trigger devices where it is desired for the device to "fail safe" so that the mechanism will not be triggered if the control medium inadvertently fails. To achieve this result it is possible to arrange the lever and the spring so that the lever is in an "over-centre" position as shown in FIG. 10 in the cocked position. In this configuration, a straight line from the anchor point 12 to the force actuating point 11 on the lever 2 lies on the opposite side of the lever pivot 3 in the cocked position as shown in FIG. 10 as it does in the firing position. The tensioning spring therefore acts to hold the lever in the cocked position even if the control medium should inadvertently fail.

In this configuration it is necessary to provide a positive form of actuation to move the lever 2 through the on-centre position (ie: with a line from anchor point 12 to force actuation point 11 passing through the pivot 3) before the lever will move to the firing position to operate the mechanism to which the trigger is attached. There are many different ways of achieving the initial movement such as by providing a bellows 35 connected to an air line 36 which can be provided with a pressure pulse from a contained fluid to expand the bellows 35 and move the lever 2 through the on-centre position to inaugurate firing of the trigger. The bellows may also be provided with a vacuum acting against a spring to keep the bellows collapsed so that as soon as air is admitted to the line 36, the bellows expand under the action of the spring to fire the trigger.

Figure 11:
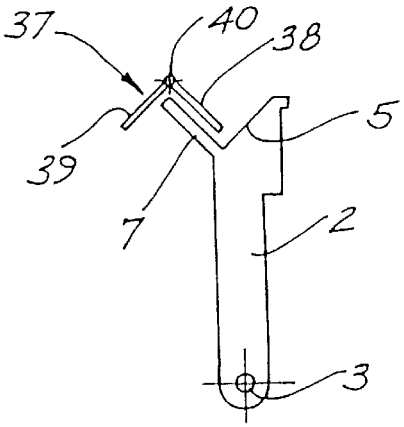
FIG. 11 is a diagrammatic view of the lever arm of the trigger device restrained and fired by a bell crank lever.

In a further development of any of the trigger forms described above, the lever arm may be restrained by a bell crank lever 37 (FIG. 11) which typically has arms 38 and 39 rigidly connected to one another and pivoting on a pivot point 40. Arm 38 of the bell crank lever typically engages one side 7 of the hopper 5 preventing rotation of the arm 2 until the bell crank lever is rotated in an anti-clockwise direction (as seen in FIG. 11) releasing face 7 and allowing the lever 2 to rotate to the firing position. A specific embodiment of this arrangement will be described later with reference to FIG. 23.

Figure 13:
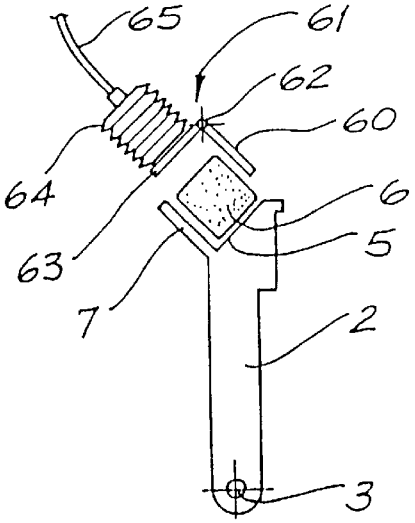
FIG. 13 is a diagrammatic view of the lever arm of the trigger device restrained independently by either a bell crank lever or by a soluble tablet.

Use of the bell crank lever permits additional forms of actuating device to be utilised and in particular allows the use of a vacuum operated bellows or other mechanism (eg: a piston and cylinder assembly) to be used in various situations, some of which will be described below. The bell crank lever can also be used to restrain a water soluble tablet allowing independent operation of the trigger either manually at the trigger (by pulling the toggle 21 and lanyard 22), automatically by immersion into water dissolving the tablet, or remotely eg: by vacuum line actuation. This configuration is shown in FIG. 13 where rotation of lever 2 about pivot 3 to the firing position is restrained by tablet 6 abutting face 7 of the hopper 5. The opposite side of the tablet abuts face 60 forming part of a bell crank lever 61 pivotally mounted on pivot 62. The other arm 63 of the bell crank lever is located eg: by a vacuum bellows 64 operable upon admission of air via line 65 to rotate the bell crank lever anti-clockwise (as seen in FIG. 13), moving face 60 away from tablet 6 and allowing the trigger to fire.

Figure 12:
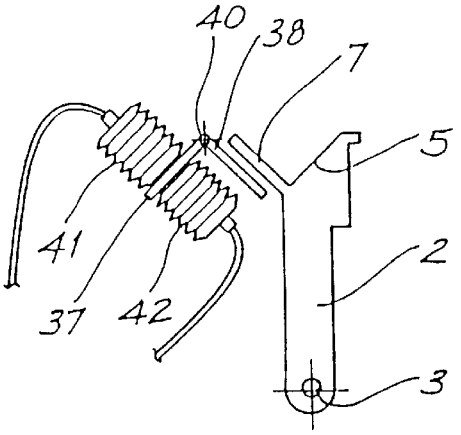
FIG. 12 is a similar view to FIG. 11 showing the configuration of the lever in an over centre cocked position.

The bell crank lever can also be used with the over-centre type configuration previously described with reference to FIG. 10 as can now be seen in FIG. 12. In this configuration the lever 2 is held in the cocked position by the over-centre location of the tension spring and is moved from that position by rotation of the bell crank lever in an anti-clockwise direction causing arm 38 to move against hopper face 7 and tip the lever 2 through the over centre position.

Actuation of the bell crank lever to achieve this anti-clockwise operation can either be by way of fluid pressure or release of vacuum applied to a bellows 41, or alternatively by vacuum applied to contract bellows 42.

Some applications would require the constant application of vacuum to restrain the mechanism in the cocked position and in that configuration, vacuum could be applied to the bellows 41 to maintain that bellows in the collapsed position. Upon release of the vacuum, ie: the inlet of air to the bellows, the bellows 41 is caused to expand rotating the bell crank lever in an anti-clockwise direction and tipping the lever 2 through the over-centre position to fire the trigger.

The use of constantly applied vacuum in this situation has the advantage that any failure of the system can allow air into the vacuum lines actuating the trigger mechanisms in situations where that is desirable. This configuration is particularly applicable to the release of emergency equipment such as life rafts and other life-saving devices on board boats or ships where the vacuum application can be manually released even in the event of a total power failure by opening a valve anywhere in the vacuum supply line to admit air into the system and actuate the bellows 41. Even in desperate situations where it is not possible to reach normal manual application valves to achieve this purpose, the entire system can be actuated by breaking or damaging the vacuum line system at any point to admit air and actuate any trigger device connected to the vacuum supply circuit.

The vacuum control described immediately above is particularly applicable to the release of life-saving devices on board ship and an example of this operation will now be described.

Figure 14:
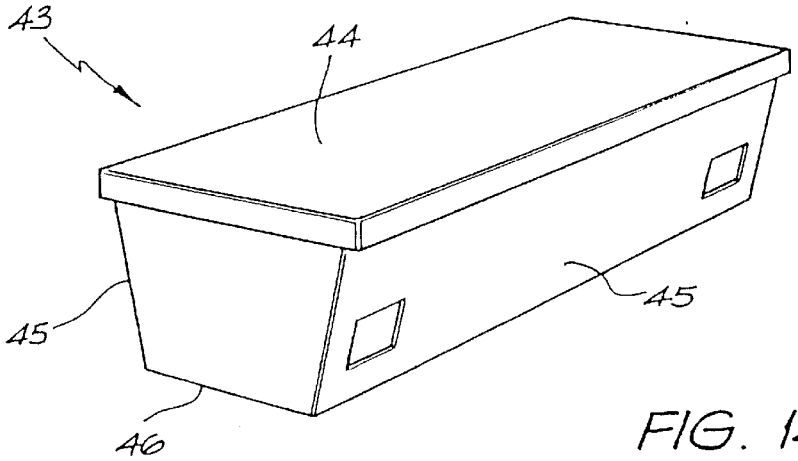
FIG. 14 is a diagrammatic perspective view of a container adapted to hold a plurality of life-saving devices and arranged to be released and/or opened by one or more trigger devices according to the invention.
Figure 15:
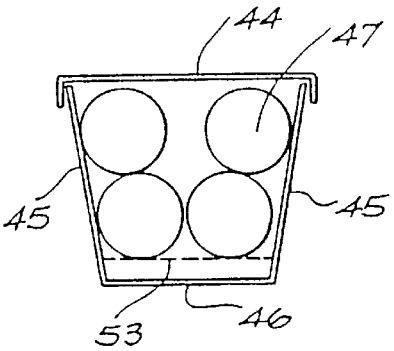
FIG. 15 is a vertical cross-section through the box of FIG. 13.

In FIG. 14 there is shown a container or box 43 having a lid 44, inwardly tapered side walls 45 and a base 46 which is narrower than the lid 44. The box may be used to contain a number of life-saving devices such as automatically inflatable life jackets or inflatable buoyancy aids 47 (FIG. 15) contained within the box. Other life saving apparatus such as floating lights, whistles, life rafts, etc., may be contained within the box.

Figure 16:
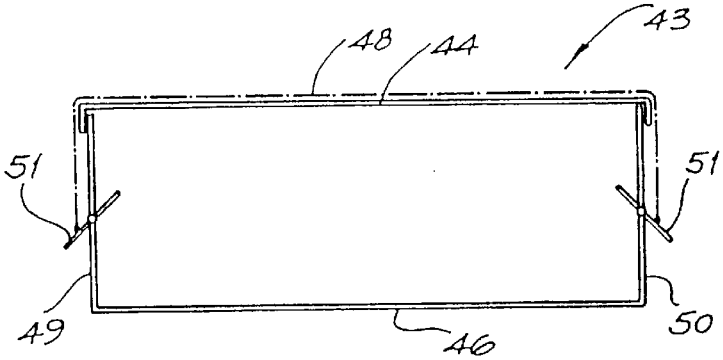
FIG. 16 is a diagrammatic cross-section through the length of box 13 showing lid restraining and releasing mechanisms.

The lid of the box 44 is spring loaded to the open position and secured in place by an elongate tension spring 48 (FIG. 16) which extends from one end of the box 49, over the lid of the box and downwardly to the opposite end 50. At each end of the tension spring it is clipped over a pivoting lever 51 so that rotation of either lever from the position shown in FIG. 16 to move the outwardly extending portion of the lever upwardly will release the end of the tension spring 48 and allow the lid 44 to spring open.

The pivoting levers 51 are connected within the box 43 to a trigger device of the type previously described so that they are automatically rotated and released upon immersion of the box in water. To prevent inadvertent operation of the trigger devices, eg: by water spray etc., the box is basically water-tight but provided with one or more inlet holes 52 near the base of the box and a perforated tray or other similar support 53 forming a false bottom to the box so that total immersion of the box in water is required before the water can reach the soluble tablets within the trigger devices to release the restraining spring 48. Alternatively the trigger device may be mounted on the outside of the box.

In an emergency, such as a sinking of a boat, or a man overboard situation, the box is simply thrown over the side of the boat whereupon the trigger devices within the box release the levers 51 allowing the tension spring 48 to release and the lid 44 to be removed from the box. The life-saving devices 47 within the box may themselves contain water soluble trigger devices of the type described above. The life-saving devices 47 are preferably attached to the box by a line so that the box and lid acts as a drogue once in the water to prevent the life-saving devices 47 from blowing away.

It is also possible to secure the box to the deck of a boat by trigger devices of the type described above so that the box will be automatically released upon the sinking or inversion of the boat. This is achieved by engaging the tension spring 48 with a restraint point such as a horizontal bar 54 (FIG. 17) extending from the deck of the ship. In this configuration the tension spring 48 is pulled downwardly on the side of the box 49 and looped over the bar 54 before extending upwardly to have one end hooked over the pivotal lever 51. In this manner the outwardly extending portion of the lever 51 is in a raised position when the spring 48 is engaged compared with the lowered position for the form of the invention shown in FIG. 16.

Figure 17:
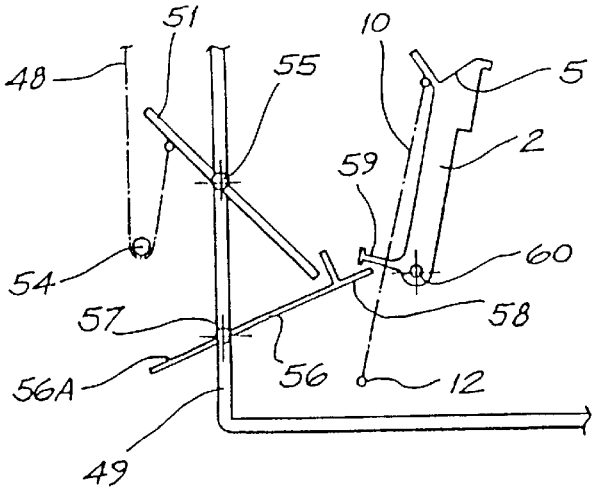
FIG. 17 is a diagrammatic view of a container and lid release device for use with the container shown in FIGS. 14–16.
Figure 18:
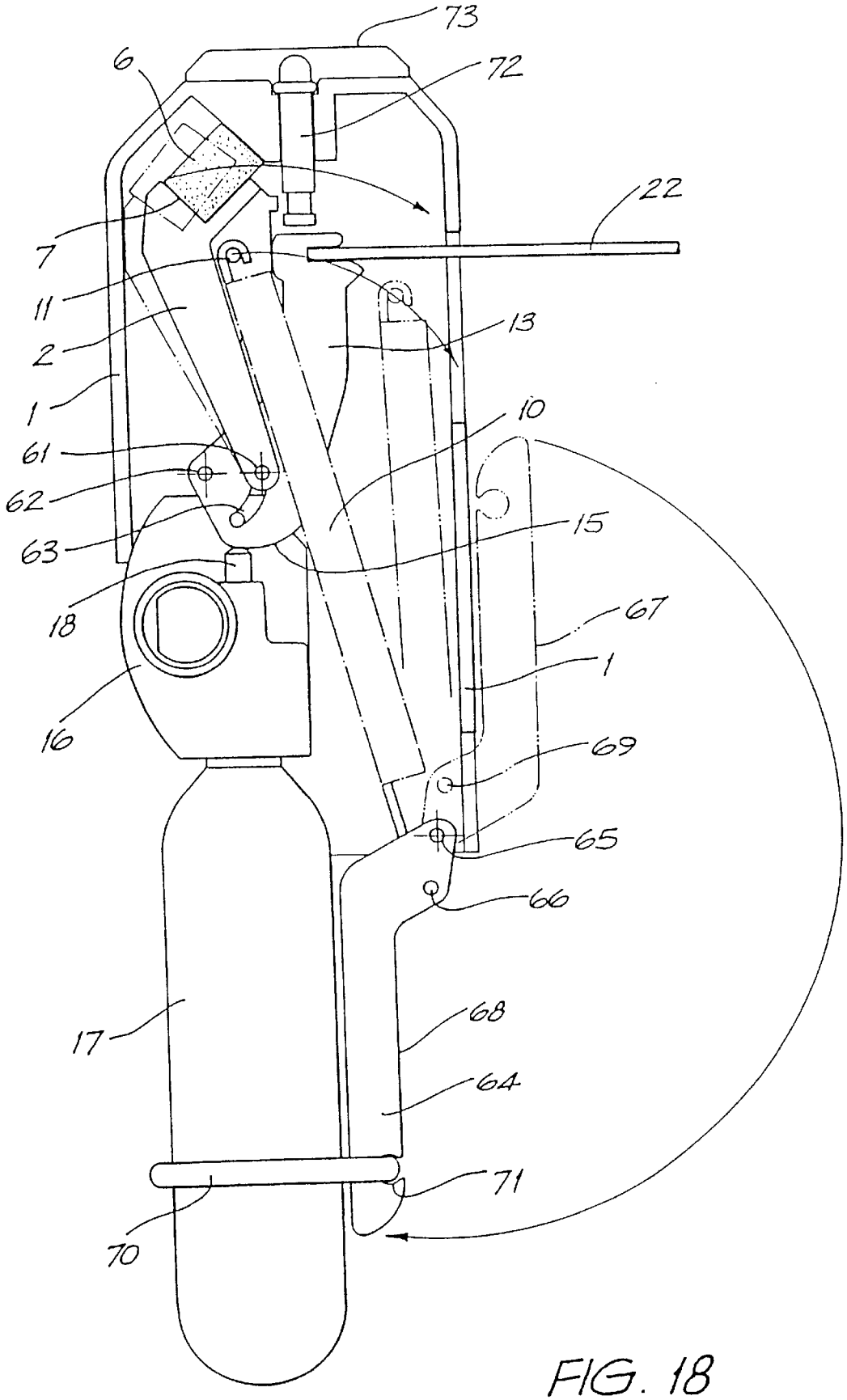
FIG. 18 is a cross-sectional elevation of a trigger device similar to that shown in FIG. 8 but with an alternative lever and cocking mechanism, shown in the cocked position.

The lever 51 which pivots about pivot point 55 is restrained from rotating beyond the position shown in FIG. 17 under the influence of spring 48 by a catch lever 56 which is in turn pivotally mounted to the side of the box 49 at pivot point 57, and extends outwardly to a manual release portion 56A.

The catch lever 56 may be moved from this position by rotation in a clockwise direction (as seen in FIG. 17) either by manual operation, eg: by kicking upwardly the manual release portion 56A, or by being struck at its remote end 58 by an arm 59 forming a bell crank lever about pivot 60 with the actuating lever 2 of the mechanism previously described. Hopper 5 can hold a soluble tablet for operation with the remainder of the trigger mechanism (not shown in FIG. 16) as described above and as actuated by a tension spring 10 from an anchor point 12. It will be appreciated that operation of the lever 2 is in fact a mirror image to that shown in the previous drawings, ie: the lever 2 rotates about pivot 60 from a cocked to a firing position in an anti-clockwise direction.

Because the bell crank lever 59 strikes the remote end 58 of the lever 56 when in the firing position, ie: when maximum moment or force is applied by the spring 10 to the lever 2, a considerable force is available to rotate the catch lever 56 against the friction caused by the spring tensions within the mechanism.

Figure 25:
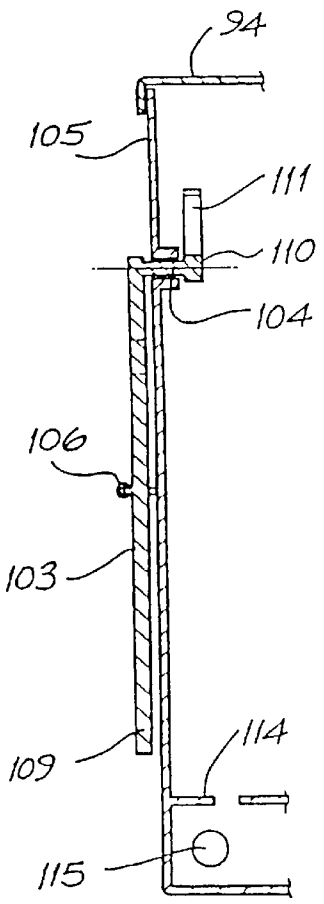
FIG. 25 is a cross-section on the line 25 of FIG. 24.

When pivotal lever 51 is released, it not only releases the lid 44 but also disengages the box from the restraint bar 54 allowing the box to float free in the event of a sinking or inversion, or to be manually thrown over the side of a ship. A particular embodiment of this arrangement will be described further later with reference to FIGS. 24 to 26.

Although one particular application of the trigger device has been described and some variations and different applications mentioned it will be appreciated that the trigger device according to the invention can be modified and used in any situation where it is desired to directly or remotely fire a certain apparatus and where it is desirable for the actual control force to be considerably less than the force available to actuate the desired mechanism.

In an alternative development of the trigger device as shown in FIGS. 18 to 21 the lever 2 is pivotally mounted in the housing 1 by a pivot pin 61. The cam actuating lever 13 is also pivotally mounted to the housing 1 by way of a pivot pin 62 and the cam actuating lever 13 incorporates an arcuate slot 63 through which the pivot pin 61 for the lever 2 passes allowing independent rotation of the cam actuating lever 13 and the lever 2.

This mounting arrangement simplifies the mounting of the levers within the housing 1 enabling the mechanism to be mounted without the necessity to mount the pivot points on the proprietary item 16.

More importantly, the embodiment shown in FIGS. 18 to 21 incorporates an additional cocking lever 64 pivotally mounted to the housing 1 by way of a pivot pin 65.

The lower anchor point 66 for the tension spring 10 is provided on the cocking lever 64 spaced from the pivot 65 as shown so that the spring 10 is tensioned when the cocking lever is moved from the uncocked position 67 as shown in broken outline to the cocked position shown in solid outline at 68. It can be seen that by so rotating the cocking lever the spring anchor point 66 moves from position 69 to the position shown at 66 in FIG. 18.

When the cocking lever is in the uncocked position 67, the tension spring 10 becomes compressed or solid, pushing against point 11 and allowing full anti-clockwise rotation of the lever 2 for insertion of the soluble tablet 6 as previously described. Once the soluble tablet has been inserted, the unit may be "cocked" by rotating the cocking lever from position 67 to position 68, tensioning the spring 10. The pivot point 65 and spring anchor point 66 are arranged so that the spring anchor point 66 moves "over centre" with regard to the pivot point 65 as the spring is tensioned so that when the lever is in the cocked position as shown at 68, the tension in spring 10 holds the lever in that position against the side of the $CO_2$ bottle 17. For security however it is desirable to provide a safety retaining strap which may conveniently take the form of a rubber O-ring 70 which is passed around the $CO_2$ bottle and engaged in notch 71 in the cocking lever 64 to securely retain the cocking lever in the cocked position.

The safety pin 72 is also slightly different in the configuration shown in FIGS. 18 to 21, having a flat head 73 which is typically brightly coloured to enable easy identification of the fact that the trigger device is disarmed from automatic firing when the safety pin 72 is engaged.

Figure 19:
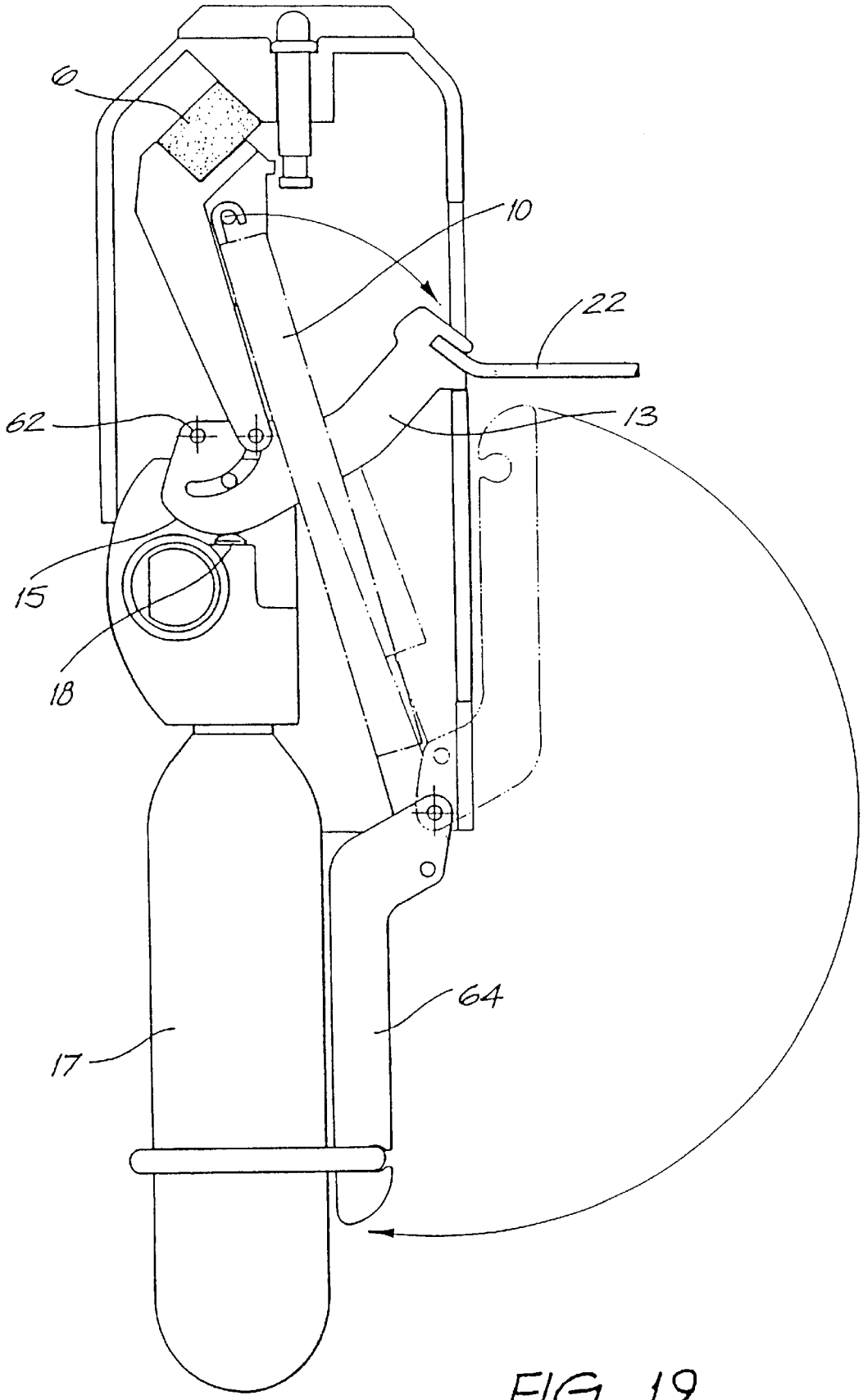
FIG. 19 is a similar view to FIG. 18 showing the trigger device manually fired.

In order to manually fire the trigger device shown in FIGS. 18 to 21, the lanyard 22 is pulled as shown in FIG. 19 rotating the cam actuating lever 13 about the pivot pin 62 causing the cam surface 15 to depress the bottle piercing mechanism 18 and release compressed $CO_2$ gas into the life-saving device. As can be clearly seen from FIG. 19, manual operation of the cam actuating lever in this way is not impeded by, and has no effect upon, the automatic firing mechanism incorporating the lever 2 and the soluble tablet 6. It will also be noted that the trigger device can be manually actuated via the lanyard 22 when the safety spin 72 is engaged and without the automatic firing mechanism being cocked.

Figure 20:
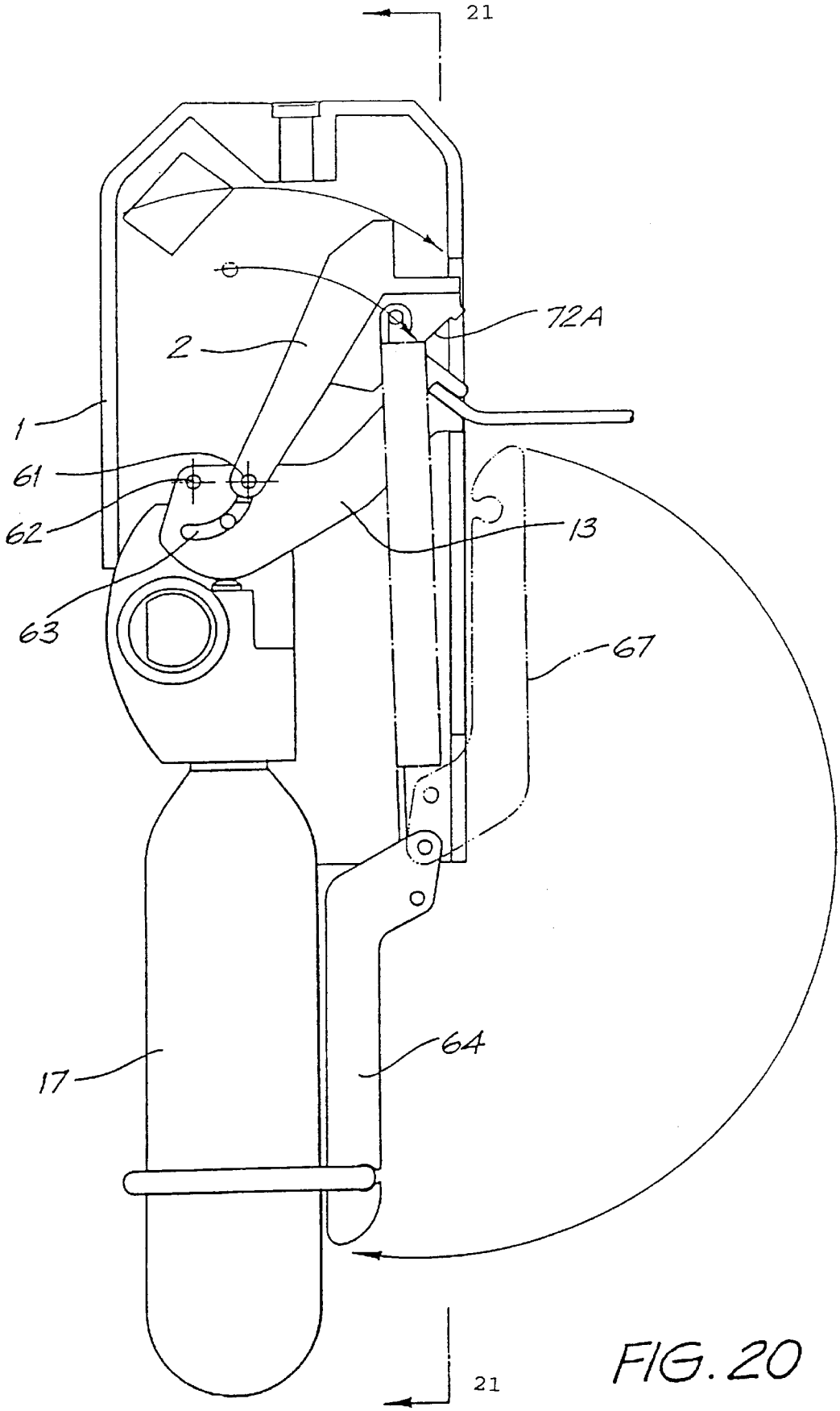
FIG. 20 is a similar view to FIG. 18 showing the trigger device automatically fired.
Figure 21:
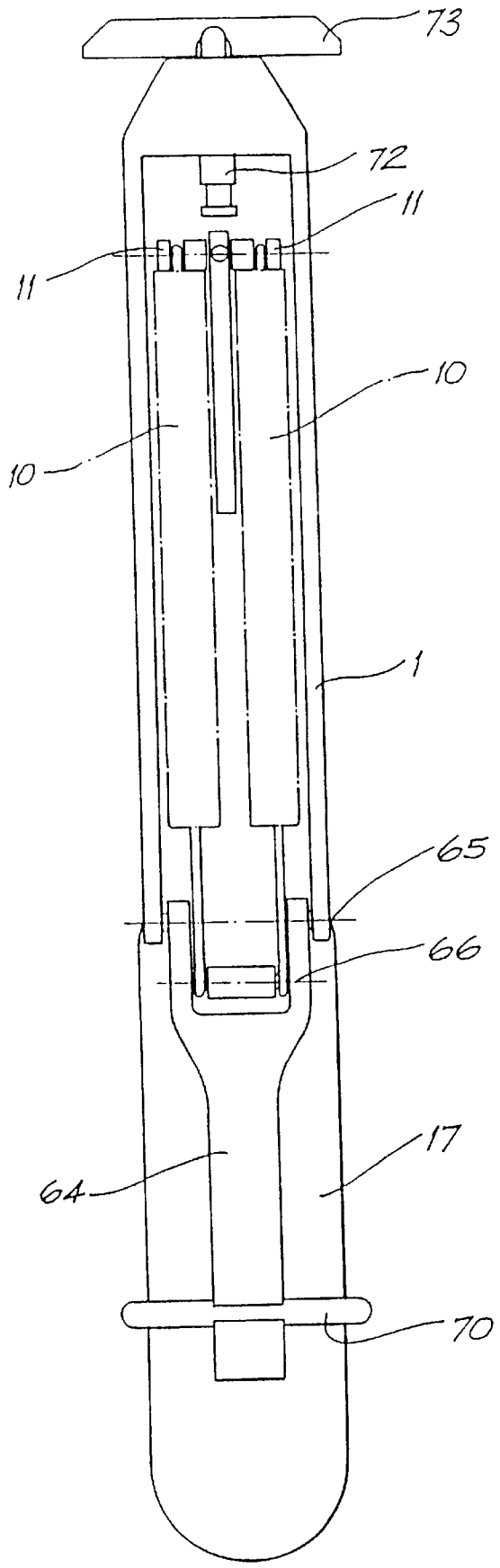
FIG. 21 is a section on the line 21 of FIG. 20.

When the safety pin 72 is withdrawn, the trigger device may be automatically fired by dissolving the soluble tablet 6 causing the lever 2 to be rotated by the action of the spring 10 to the firing position shown in FIG. 20. As the lever 2 rotates about its pivot 61, the face 72A on lever 2 bears against the head of the cam actuating lever 13 causing that lever to rotate to the firing position as shown in FIG. 20. From this position it is a simple matter to re-arm the trigger device by releasing the cocking lever 64, rotating it to position 67 and thereby releasing tension on the spring 10. The lever 2 is then simply rotated to its original position for insertion of a new soluble tablet 6.

Figure 22:
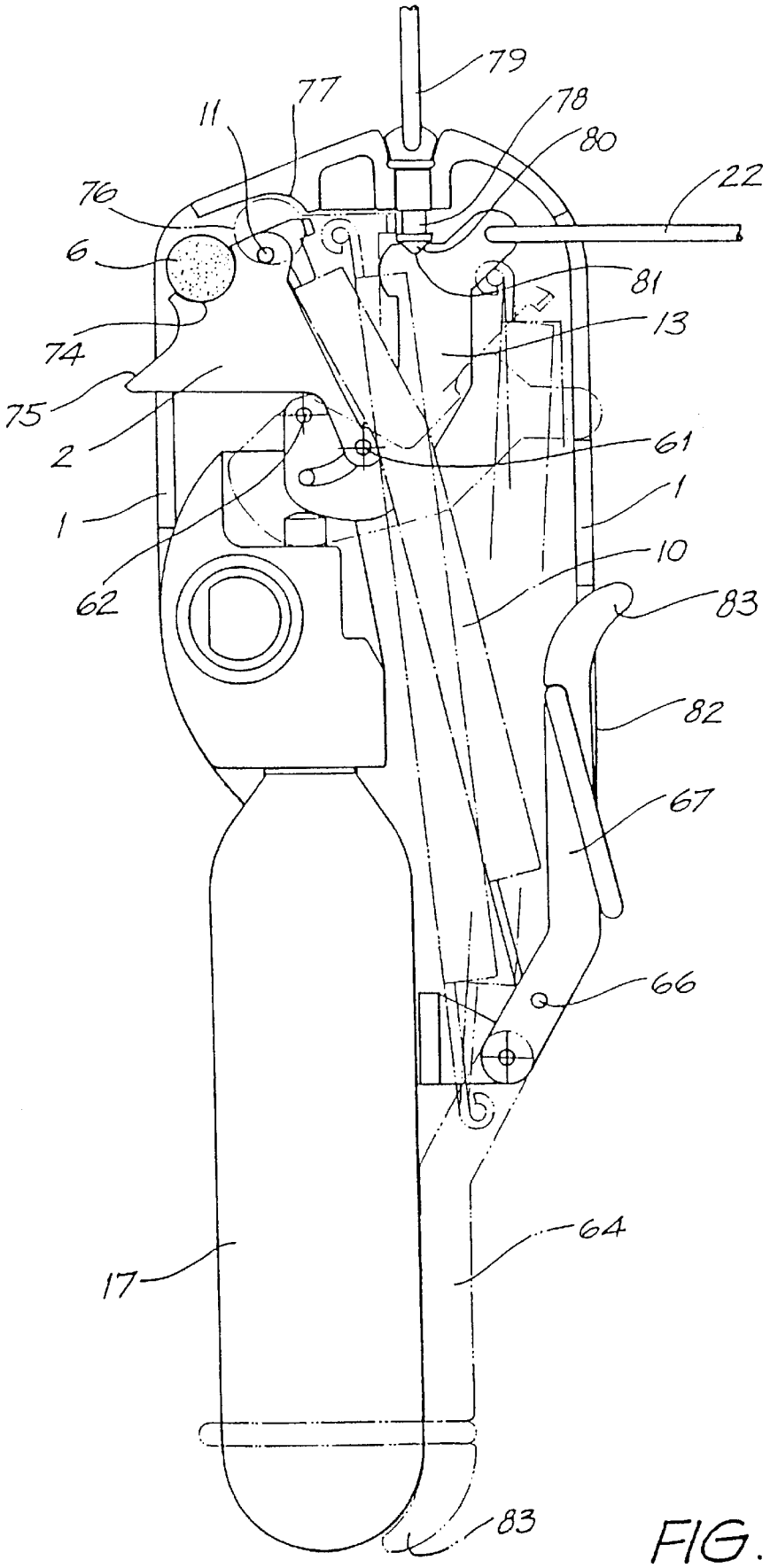
FIG. 22 is a cross-sectional elevation of a further embodiment of the trigger device shown in FIG. 18.

In a still further embodiment of the invention as shown in FIG. 22, the pivot point 61 and the spring attachment points 11 and 66 are arranged so that the spring 10 is bent over the pivot point 61 when the lever 2 is over rotated for insertion of the soluble tablet 6.

In this particular embodiment the soluble tablet is cylindrical in configuration and nests in a hopper in the form of a concave housing 74 in the lever 2. The lever 2 is also provided with a protruding thumb rest portion 75 which protrudes through an aperture in the edge of the housing 1 when the lever 2 is over rotated to the position shown in FIG. 22.

In this embodiment, when the cocking lever 64 is moved to the uncocked position 67 and the spring 10 pushes the lever 2 back to the. "cocked" position, the lever 2 can then be over rotated by pressing down on the thumb rest 75 through the opening in the housing causing further or over rotation to the position shown. In this position the soluble tablet can be inserted into the concavity 74 in the lever 2 through the opening in the edge of the housing 1 and the lever 2 is then pulled back to the position where the soluble tablet is located as shown in dotted outline at 76, i.e. resting against abutment 77 in the housing 1, by the tendency of the spring 10 to return to the straightened configuration. This prevents inadvertent dislodging of the soluble tablet and provides a degree of protection for the tablet.

In this embodiment, the cocking lever 64 may be incorporated within the housing 1 by way of a slot 82 and may be provided with an out-turned portion 83 protruding through the slot in the casing 82 for initial movement of the cocking lever from the uncocked position 67 to the cocked position shown in broken outline at 64. It will also be noted that the outwardly turned portion 83 nests neatly beneath the end of the $CO_2$ bottle 17 when in the cocked position.

It is also a feature of the trigger device shown in any of the embodiments heretofore described that because of the way the soluble tablet 6 is located in a recess or hopper in the arm 2, it is possible to use two or more suitable tablets in a side-by-side configuration. This has the advantage that if one tablet should prove to be defective, e.g. prone to early crumbling or failure due to adverse atmospheric conditions, the remaining tablet or tablets will remain intact and prevent the operation of the trigger device. Because the multiple tablets are located in the apparatus in "parallel", they would all be dissolved equally quickly by immersion in water so that the use of multiple tablets in this fashion would not delay the correct firing of the trigger device in predetermined conditions. This is a considerable advantage over known prior art types of trigger device using soluble tablets where it is either not possible to use more than one soluble tablet at a time or where the tablets must be placed one on top of the other so causing at least partial firing of the trigger device should one tablet inadvertently collapse.

In the embodiment shown in FIG. 22, the safety pin 78 is also different in configuration and may typically be attached to a lanyard 79 having a toggle or other device at its distal end (not shown) for easy removal or withdrawal of the safety pin from the engaged position shown in FIG. 22. It is a further feature that the lower end 80 of the safety pin is shaped to engage in a recess or dimple 81 in the upper end of the cam actuating lever 13 to provide a degree of initial resistance of that lever from the position shown in FIG. 22 to the firing position. In known prior art devices of a similar nature, the equivalent of the lever 13 is typically located by a shear pin or a U-clip which is broken or dislodged upon firing the trigger device, e.g. by pulling the lanyard 22 and this has the disadvantage that the shear pin or U-clip needs to be replaced after each use of the trigger device.

By way of contrast the embodiment shown in FIG. 22 provides a degree of initial resistance to operation of the cam actuating lever 13 via the lanyard 22 without necessitating the use of any reusable or loose components within the trigger device.

It is also possible to vary any of the trigger devices previously shown to incorporate the forms of actuation previously described with reference to FIGS. 9 to 13. By way of example only a description will now be given of a variation shown in FIG. 23 wherein a bell crank lever of the type diagrammatically shown in FIG. 11 is incorporated into the trigger device previously described with reference to FIG. 22.

In this configuration the water soluble tablet 6 when located in the position 76 ready for actuation of the trigger device, is located against a curved portion 84 of a bell crank lever 85 rather than against the abutment portion 77 of the housing 1 as seen in FIG. 22. The housing in the configuration shown in FIG. 23 is enlarged in portion 86 to accommodate movement of the curved arm 84 of the bell crank lever 85 within the housing.

The bell crank lever 85 is pivoted to the housing at pivot point 87 and further incorporates an actuation arm 88. This arm may be actuated by a force applied according to arrow 89 at point 90 or by any of the other methods previously described with reference to FIGS. 9 to 13.

Figure 23:
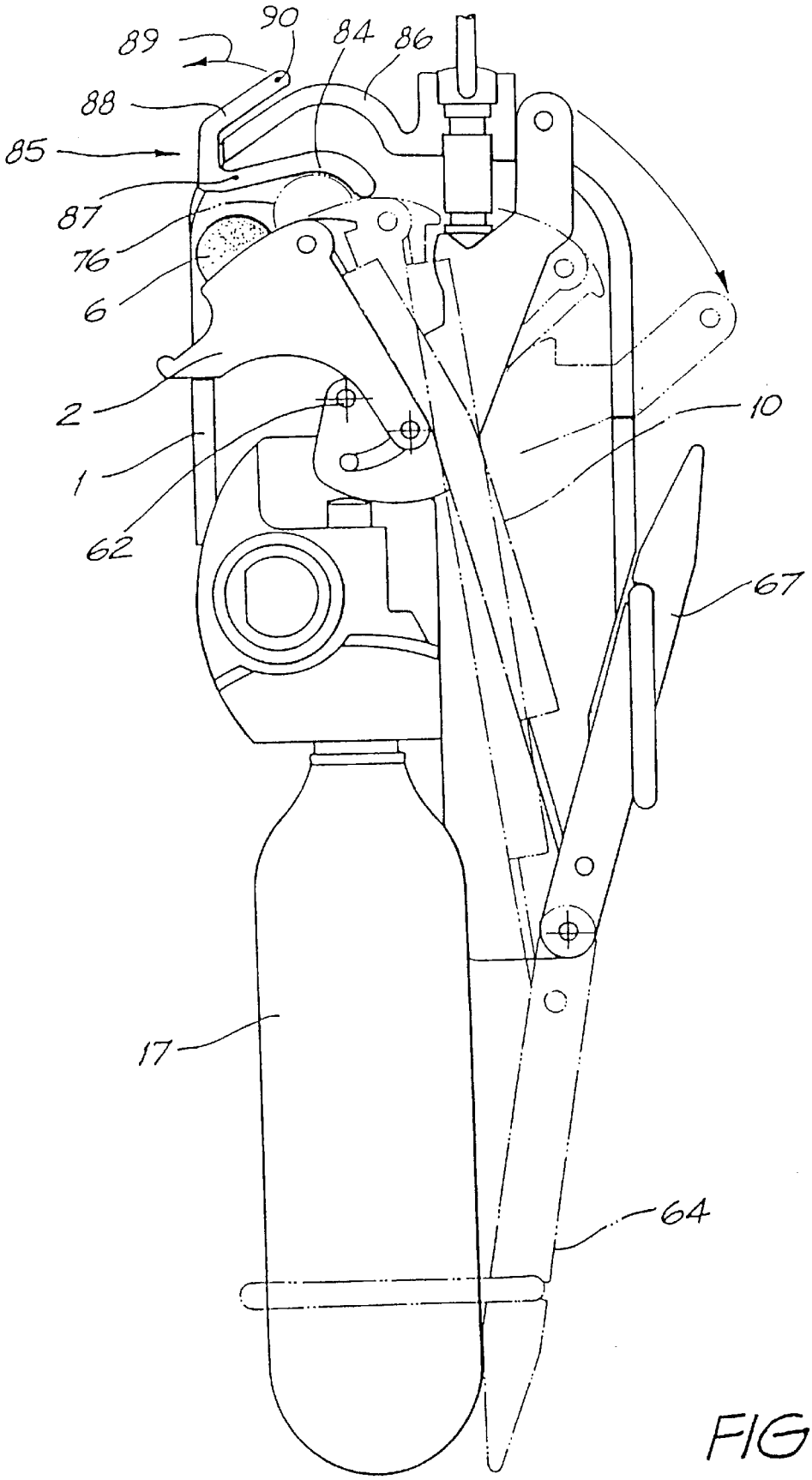
FIG. 23 is a cross-sectional elevation similar to FIG. 22 showing the use of remote actuation via a bell crank lever.

In the configuration shown in FIG. 23 it is possible to remotely fire the trigger device by causing the bell crank lever 85 to rotate about pivot 87 under the influence of force 89. This anti-clockwise movement (as seen in FIG. 23) causes the curved portion 84 to "lift" away from the soluble capsule in position 76 allowing the lever 2 to rotate under the influence of the spring 10 and fire the device as previously described.

The trigger device which has been described with reference to FIGS. 22 and 23 can also be utilised in a particular embodiment of the "float off box" previously described with reference to FIG. 17. This will now be described in further detail with reference to FIGS. 24 and 25.

The float off box 91 is designed for mounting on the deck or other convenient location of a vessel secured to a horizontal stanchion 92 by way of an elongate elastic shock cord or spring 93 passing over the top of the box 94 being directed down each side in portions 95, around the stanchion 92 and then upwardly in portion 96 being secured by a hook 97 located in a notch 98 in lever arm 99. The float off box 91 is secured to the deck of the vessel and the lid 94 secured to the box by the single loop of shock cord or the like. The lever arm 99 is pivotally mounted to the side of the box by way of pivot point 100 and is restrained from moving upwardly at free end 101 by way of a notch or pawl 102 on a actuating lever 103. The actuating lever 103 is in turn pivotally mounted to the side of the float off box by way of a pivot pin 104 which is rigidly attached to the lever 103 and which extends through the side wall 105 of the box as can be clearly seen in FIG. 25. The actuating lever is held in place against the end of the lever arm 101 by way of a tension spring 106 secured between an anchor point 107 on the side of the box and a mounting point 108 on the actuating lever 103. The distal end 109 of the actuating lever 103 protrudes beyond the spring 106 and acts as a manual actuating lever to release the float off box as will be described further later.

An internal actuating lever 110 is located within the float off box rigidly attached to the pivot pin 104 so that it rotates with the external actuating lever 103. The internal actuating lever 110 ends in an upwardly extending portion 111 which is aligned with an actuating tongue 112 forming part of a trigger device 113. The overall trigger device is of the type previously described with reference to FIGS. 22 or 23 but only the lever arm portion 2 of that trigger device and the tension spring 10 are shown for clarity. The tension spring 10 is armed or cocked by way of the cocking lever 67 as previously described.

Figure 24:
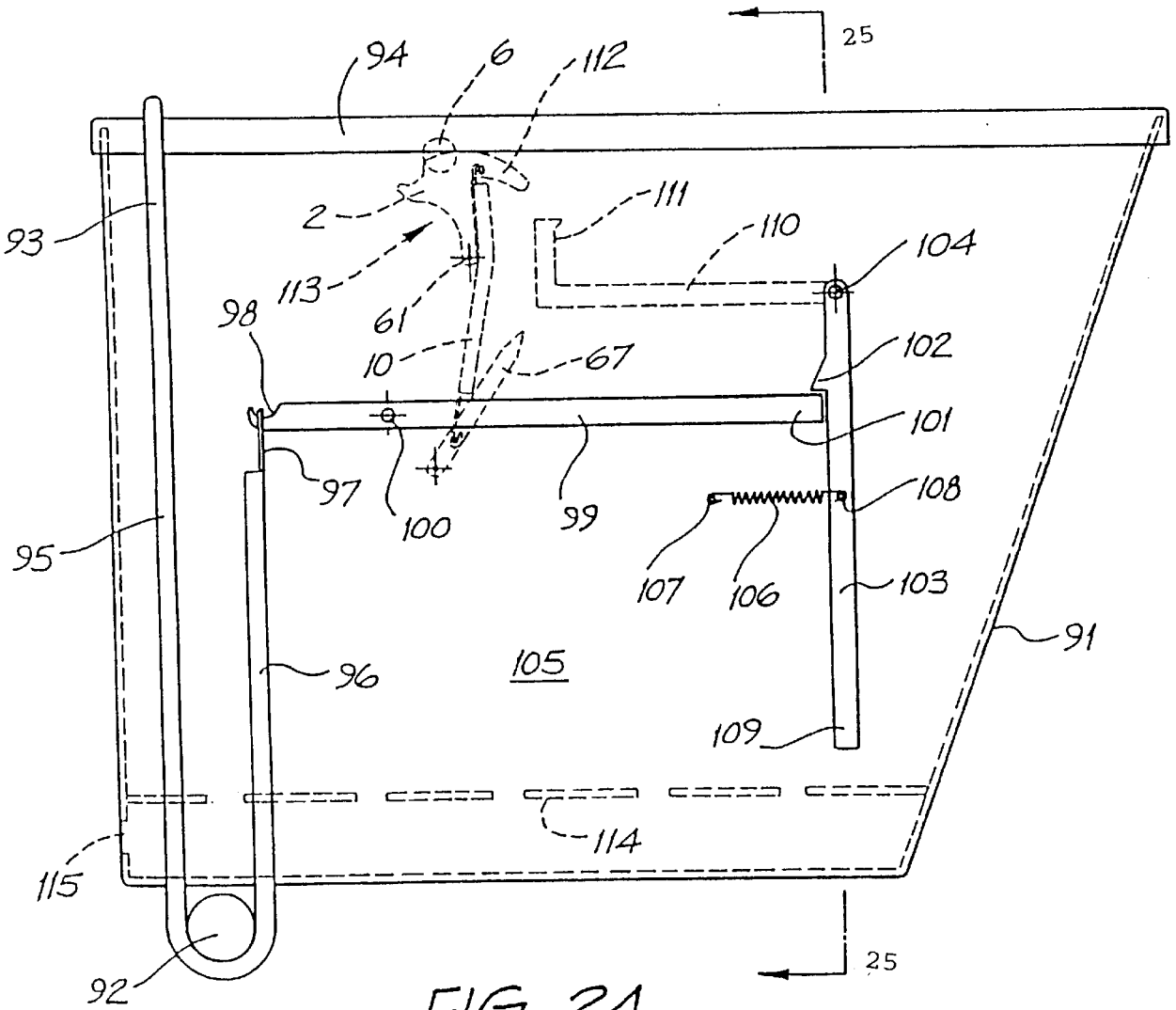
FIG. 24 is an end view of a float off box incorporating a trigger mechanism.

In use when the trigger device is actuated either by a remote control of the type described in connection with FIG. 23 or by dissolving the soluble tablet 6, the lever arm is forced to rotate under the action of the spring 10 about pivot 61 causing the end of the actuating tongue 112 to forcibly strike the upturned end of the upwardly extending portion 111 of the internal actuating lever 110. The internal actuating lever 110 is forced to rotate in an anti-clockwise direction as seen in FIG. 24 causing rotation of the pivot pin 104 and subsequent anti-clockwise rotation of the external actuating lever 103. This rotation releases the end 101 of the lever arm 99 from the notch or pawl 102 allowing the lever arm 99 to rotate in an anti-clockwise direction under tension from the shock cord 96 and release the hook 97 from notch 98. The shock cord is then generally released allowing it to become disengaged from the horizontal stanchion 92 and to release the lid 94 from the box 91. In this manner the float off box may be released from the deck of the vessel by operation of the trigger device 113.

Alternatively the box may be manually released by moving the end 109 of external actuating lever 103 to the right as seen in FIG. 24 releasing end 101 of lever arm 99 from the notch or pawl 102 and permitting release of the box and lid as previously described.

In order to facilitate automatic operation of the float off box, the bottom of the box may be provided with a mesh or grid 114 on which inflatable life-saving devices are mounted within the box as previously described and the box may have a water entry hole 115 permitting water to flood into the box on sinking of the vessel. To facilitate this operation, air vent holes as required may be provided in the upper part of the box. Once the water level reaches the soluble tablet 6, that tablet dissolves automatically actuating the trigger device 113 and setting in train the release mechanism previously described.

I claim:

1. A trigger device adapted to actuate a desired mechanism, said trigger device comprising a primary lever mounted at one end thereof by a pivot to a support structure, tensioning means connected between a force actuation point on the lever remote from the pivot and an anchor point on the support structure, arranged to bias the lever into a firing position wherein the mechanism is actuated, restraint means operable between the lever and the support structure at a point on the lever remote from the pivot and arranged to hold the lever in a cocked position against the bias of the tensioning means until the device is fired by operation of the restraint means allowing the tensioning means to bias the lever into a firing position, and cocking means operable to facilitate rotation of the primary lever from the firing position to the cocked position, and wherein the pivot, the anchor point, and the restraint means are positioned on the support means such that the distance between a line from the force application point to the anchor point and the pivot is significantly less in the cocked position than in the firing position.

2. A trigger device as claimed in claim 1 wherein the cocking means incorporates a cocking lever rotatable to apply tensioning force to the tensioning means.

3. A trigger device as claimed in claim 1 wherein the mechanism is actuated by a secondary lever pivotally mounted at an end thereof to the support structure and arranged to be rotated from a cocked position to a firing position by movement of the primary lever from the cocked position to the firing position, and further arranged to allow rotation of the secondary lever from the cocked position to the firing position independently of the primary lever, and wherein the secondary lever can be manually rotated from the cocked position to the firing position causing manually effected actuation of the desired mechanism.

4. A trigger device as claimed in claim 3 wherein the desired mechanism includes a pin arranged to pierce the seal on a compressed gas bottle and wherein the pin is moved axially by a cam surface rotated by the secondary lever and wherein the cam surface incorporates a portion of substantially constant radius arranged to bear against the pin during initial rotation of the secondary lever.

5. A trigger device as claimed in claim 1 wherein the line from the force application point to the anchor point lies on one side of the pivot in the cocked position and on the opposite side of the pivot in the firing position, such that in the cocked position the lever is held in an "over center" location against an abutment on the support structure and the restraint means is operable to rotate the lever from this position past the on-center position permitting the tensioning means to further rotate the lever into the firing position.

6. A trigger device as claimed in claim 3 wherein the primary lever is restrained from rotating from the cocked position to the firing position by a removable safety pin protruding into the path of the primary lever, while still allowing rotation of the secondary lever.

7. A trigger device as claimed in claim 6 wherein the end of the safety pin, when in place, engages a detent in the secondary lever causing a resistance to initial movement of the secondary lever from the cocked position by manual rotation.

8. A trigger device as claimed in claim 1 wherein the restraint means comprises a water soluble tablet held between mutually facing surfaces on the primary lever and the support structure respectively.

9. A trigger device as claimed in claim 8 wherein the surfaces in the primary lever arranged to hold the water soluble tablet comprise a hopper, and wherein a tablet can be loaded into the hopper by over rotation of the primary lever beyond the cocked position to align with an aperture in the housing through which the tablet may be inserted, return of the primary lever to the cocked position moving the hopper out of alignment with the aperture and securely locating the tablet within the hopper and wherein the tensioning means comprise a helical tension spring and wherein over rotation of the primary lever causes bending of the spring, so providing a biasing force tending to return the primary lever to the cocked position.

10. A trigger device as claimed in claim 2 wherein the tensioning means comprise a helical spring and wherein movement of the cocking lever from the cocked position in which the spring is tensioned to the uncocked position causes the spring to push against the primary lever at the force actuation point so rotating the primary lever to its cocked position.

* * * * *